US005742871A

United States Patent [19]

May et al.

[11] Patent Number: 5,742,871

[45] Date of Patent: Apr. 21, 1998

[54] HIGH DUTY CYCLE SAWTOOTH AC CHARGER

[75] Inventors: John W. May, Rochester; Martin J. Pernesky, Hornell, both of N.Y.

[73] Assignee: Eastman Kodak Company, Rochester, N.Y.

[21] Appl. No.: 706,097

[22] Filed: Aug. 30, 1996

[51] Int. Cl.[6] ..... G03G 15/02

[52] U.S. Cl. ..... 399/89; 399/170; 399/171; 250/324; 361/225

[58] Field of Search ..... 399/50, 89, 115, 399/170–173; 250/324–326; 361/225, 230

[56] References Cited

U.S. PATENT DOCUMENTS

| | | |
|---|---|---|
| 3,581,149 | 5/1971 | Tanaka et al. . |
| 3,624,392 | 11/1971 | Kurahashi et al. . |
| 3,699,335 | 10/1972 | Giaimo, Jr. . |
| 3,744,898 | 7/1973 | Kurahashi et al. . |
| 4,004,209 | 1/1977 | Lawson . |
| 4,038,593 | 7/1977 | Quinn . |
| 4,166,690 | 9/1979 | Bacon et al. . |
| 4,533,230 | 8/1985 | Fletcher et al. . |
| 4,646,196 | 2/1987 | Reale . |
| 4,731,633 | 3/1988 | Foley et al. . |
| 4,910,400 | 3/1990 | Walgrove . |
| 5,101,107 | 3/1992 | Stoot . |
| 5,229,819 | 7/1993 | Beresniewicz et al. . |
| 5,367,366 | 11/1994 | Kido et al. . |
| 5,466,938 | 11/1995 | Nakayama et al. . |
| 5,539,501 | 7/1996 | Yu et al. ..... 355/221 |
| 5,587,584 | 12/1996 | Bergen . |

*Primary Examiner*—R. L. Moses
*Attorney, Agent, or Firm*—Nelson Adrian Blish

[57] ABSTRACT

This invention pertains to a sawtooth AC charger (10) in which an AC voltage signal applied to sawtooth blades (12) has a duty cycle greater than 50%. Duty cycles above about 70% increase the uniformity of negative charging without significantly increasing the peak voltage to the sawtooth blades.

13 Claims, 6 Drawing Sheets

HIGH DUTY CYCLE SAWTOOTH AC CHARGER

BACKGROUND OF THE INVENTION

1. Field of the Invention

This invention pertains to AC corona chargers in general and in particular to sawtooth AC corona chargers wherein an asymmetric voltage waveform is applied to the blades of the charger.

2. Description of the Prior Art

In an electrophotographic copying system, a photoconductive element is moved past a corona charger which applies a uniform, electrostatic charge to the photoconductive element. After leaving the vicinity of the corona charger, the photoconductive element moves past an exposure system at which it is exposed to a light image of an original, to cause the charge to be altered in an imagewise pattern to form a latent image charge pattern. Following exposure, the latent image charge pattern is developed by application of toner particles to the photoconductive element to cream a toned image. Finally, this image is transferred from the photoconductive element to a receiver sheet and fused to form a permanent image.

AC charging typically uses a corona wire charger in which a high voltage signal is applied to the corona wires to produce corona emission. This signal usually has an AC voltage component superimposed on a DC offset voltage. When the time duration of the positive and negative excursions of the AC component of the waveform are equal, the corona charger is operating at a 50% duty cycle. Other duty cycles are possible. For example, for negative charging using a hypothetical square wave, a negative duty cycle of 80% would require an AC signal in which the negative excursion is four times longer than the positive excursion. For positive charging, a positive duty cycle of 80% would give an AC signal in which the positive excursion is four times longer than the negative excursion. A duty cycle of 100% for either polarity is equivalent to DC charging.

AC corona charging of a photoconductor using a corona-wire charger is much less efficient than DC charging. When a control grid is used for AC or DC charging with a corona-wire charger, the efficiency is also substantially reduced because a considerable portion of the current emitted by the corona wires is absorbed by the grid, and therefore only a fraction is transmitted to the photoconductor. When an uncharged photoconductor begins to be charged by a typical gridded corona wire charger (in which both polarities of corona current are emitted during each voltage cycle), current is transmitted to the photoconductor only in that portion of the AC waveform in which the emission has the same polarity as the grid. This occurs in alternate half-cycles (50% duty cycle). Therefore, the initial charging current has the same polarity as the grid, and charging is effectively in a pulsed DC mode. When the surface potential of the photo conductor has been charged to a voltage near that of the grid, current of polarity opposite to that of the grid starts to be transmitted also, in the other half-cycle. Typically this happens when the magnitude of the surface potential is about 100 volts less than the grid potential. Above this potential, as the surface potential of the photoconductor continues to rise, the charging mode becomes AC, and the net charging current contains an increasing proportion of current of opposite polarity. When the two components of current are equal, the maximum time-averaged charge level on the photoconductor is attained. Typically, this occurs when the surface potential is about 100 volts higher than the potential of the control grid, Vg.

Uniformity of charging is closely related to the uniformity of corona current emitted along the length of a corona wire. For negative charging, charging uniformity is normally much higher with AC charging than with DC corona charging. For example, negative AC charging using a grid, at 50% duty cycle, is significantly less noisy than negative DC charging. DC emitted currents typically show significant fluctuations at each position on a corona wire. These fluctuations are usually considerably worse with negative corona discharges than with positive corona discharges. Moreover, the sites of these fluctuations and their intensities may not be fixed spatially, but move around, or flicker, from place to place. Charging uniformity can be adversely affected by these fluctuations, resulting in unwanted density fluctuations or streaks in toned images, especially for negative charging.

One type of charging device, referred to in general as a sawtooth corona charger, has an electrically conductive electrode strip that has projections, pins, scalloped portions, or teeth integrally formed with, and extending from, an edge of the strip. Application of high voltage causes corona emission from the sharp points at the ends of the pins or teeth. This arrangement provides significant structural and operational advantages over wire electrodes, including comparatively high structural strength and reduced levels of undesirable ozone emissions. Sawtooth chargers are used commercially for negative DC charging, and a control grid is normally employed with the resulting loss of efficiency described above.

Prior art discloses wire chargers using duty cycles greater than 50%. U.S. Pat. No. 4,910,400 discloses a programmable DC charger with a high voltage corona wire between an electrode and a photoconductor. A voltage pulse is applied to the electrode of the same polarity as the DC voltage applied to the corona wire, such that the corona charge produced by the wire is periodically accelerated by the electrode. The duty cycle of the pulsed voltage applied to the electrode controls the on-off time of the corona charger. U.S. Pat. No. 4,166,690 describes a power supply in which a digital regulator, in conjunction with at least one pulse width modulated power supply, permits fast rise times of the power supply current. This is useful in defining an interframe edge. U.S. Pat. No. 4,731,633 describes a corona charger, for positive charging, without a grid, in which a negative polarity voltage pulse is applied periodically to the corona wire for the prevention of positive streamer discharges, or "sheeting". This negative polarity voltage pulse is applied to the corona wire "in a manner having minimal effect on charging functions," for example, during the cycle-up period, cycle-out period, and standby period. An example is given in which a negative pulse duration of 20 ms follows a positive current signal pulse duration of 180 ms. This is equivalent to a positive duty cycle of 90%. This waveform has a frequency of 5 Hz, which is far outside of the usual range of AC operation and is used for operation between frames. U.S. Pat. No. 4,038,593 is for an AC power supply with regulated DC bias current. The duty cycle of the AC waveform is constrained, such that the time average of the voltage signal is essentially zero, i.e., the polarity of the voltage waveform which has a shorter duration has a higher amplitude. The regulation of the DC bias current is achieved without the use of a grid by varying the duty cycle. The DC bias current controls the level of charge on the photoconductor. U.S. Pat. No. 3,699,335 is for an apparatus that energizes a corona wire with voltage pulses of constant amplitude. The width or frequency of the pulses is controlled in response to an error signal to regulate the applied charge.

U.S. Ser. No. 08/613,647, filed Mar. 11, 1996, assigned to the same assignee as the present invention, discloses the use of high duty cycle AC corona charging using a gridded corona wire charger in which the potential of the corona wire is above the corona threshold for both polarities of the AC signal. U.S. Ser. No. 08/671,461, filed Jun. 27, 1996, assigned to the same assignee as the present invention, describes the use of two pulsed DC chargers operating in tandem to produce alternate portions of the AC cycle, which includes a programmable dead time, whereby the pulse width of each polarity can be separately controlled for application to high duty cycle charging.

U.S. Pat. No. 4,533,230 describes a gridded charger in which an array of pin or needle electrodes is used for negatively charging a charge-retentive surface, and in which the voltage signal applied to the pins is pulsed DC at 50% duty cycle. Applying pulsed DC to generate a corona means that only one polarity of current is emitted by the pins. Therefore, only one polarity of charge can arrive at a photoconductor surface for all levels of charging of the photoconductor. This is different from a gridded AC corona wire charger, which allows charges of both polarities to reach the photoconductor after the surface potential has risen to near the limiting voltage determined by the grid bias (as described above). According to this patent, pulsed DC voltage on the pins, using a square waveform, provides much greater emission uniformity from pin-to-pin than when the charger is operated in a negative DC mode at approximately the same time-integrated charging current. However, in order to achieve approximately equal time-integrated charging currents for both pulsed DC and DC pin charging, the peak voltage in the pulsed DC mode must be disadvantageously higher than in the DC mode, since the charging current is instantaneously on for only half the time at 50% duty cycle. The higher peak voltage makes the charger more susceptible to arcing. Also, charger life for this type of charger is determined to a great extent by deleterious erosion and pitting of the sharp emitting points by the corrosive atmosphere produced locally by the corona discharges. Therefore, operating in pulsed DC mode with higher peak voltage at 50% duty cycle, and therefore at higher current density and higher average power than DC, means that charger life can be expected to be shortened adversely, compared to DC operation at the same time-integrated charging current.

SUMMARY OF THE INVENTION

An object of the present invention is to provide means for improving the charging uniformity of gridded sawtooth corona chargers, especially for negative charging. Another object of the invention is to improve charging uniformity by operating at voltages that are not high enough to adversely affect charger life, and are low enough to keep the propensity for arcing negligible. It is yet another object of the invention to employ low operating voltages to lower the cost and increase the reliability of the high voltage power supply required to operate the charger.

The present invention is for a sawtooth AC corona charger which has a duty cycle greater than 50%. In one embodiment of the invention, the potential on a sawtooth blade of the corona charger is greater than a threshold voltage for corona emission for each polarity. In another embodiment of the invention, negative charging is applied to a photoconductor at a duty cycle greater than 50%.

In yet another embodiment of the invention, negative AC charging is done with a duty cycle greater than 50%, such that the time-integrated charging current is the same as that from a charger operated at 50% duty cycle. This is accomplished by lowering the peak voltage amplitudes of the AC component of the voltage waveform. For example, with negative charging, the peak negative excursion of the sawtooth blade potential is reduced as the negative duty cycle is increased, thereby reducing the emission current at the sawtooth blades and so reducing the instantaneous current transmitted by the grid. For 70% duty cycle operation, the reduction in peak voltage is approximately 1,000 volts. By working at lower peak sawtooth blade voltage, the possibility of an arc to the grid is reduced, thereby improving the performance reliability of the charger. In addition, lower peak voltage allows the use of a less expensive, more reliable AC corona power supply.

DETAILED DESCRIPTION

Figure 1:
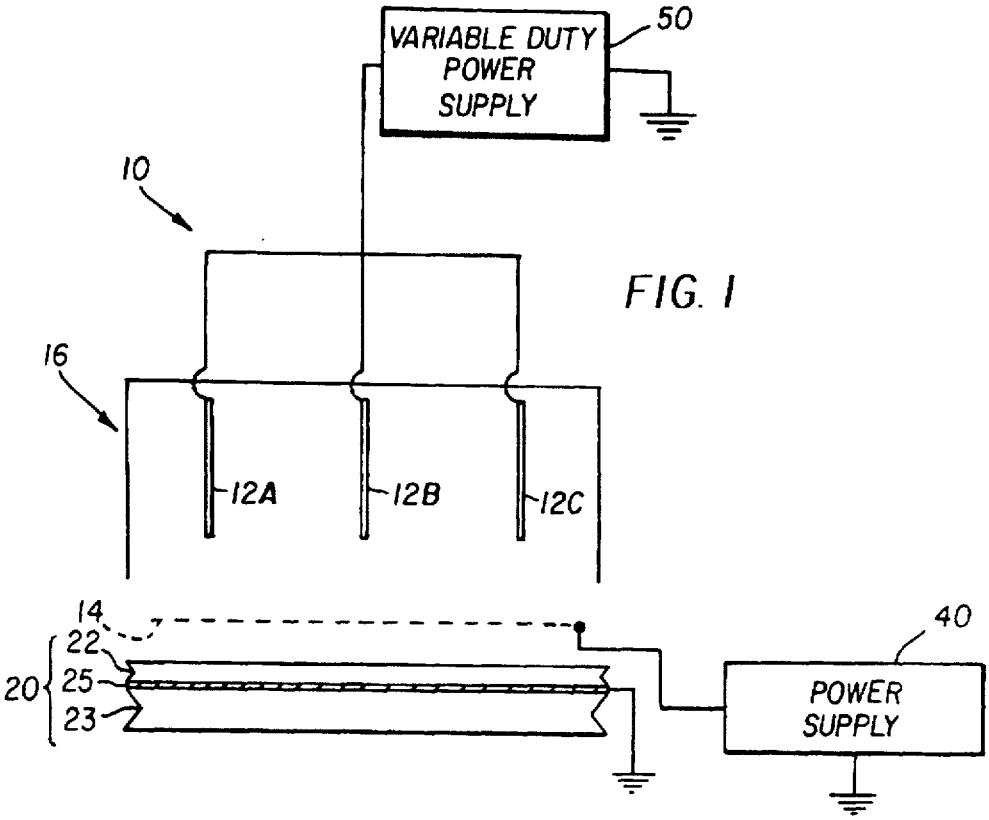
FIG. 1 is a schematic view of a sawtooth AC corona charger according to the present invention.

A sawtooth AC corona charger, referred to in general by numeral 10, is shown schematically in FIG. 1. Charger 10 has sawtooth blades 12, a grid 14, and a shell 16. Shell 16 is located a preselected distance from a surface of photoconductor 20 and is preferably constructed of insulating plastic.

The photoconductor 20 consists of a photosensitive layer 22, a grounded conductive layer 23, and a base 25. The photoconductor may be in the form of a drum or a web.

Power supply 40 maintains the potential of grid 14 at a preselected level. For negative charging the grid voltage is set at a value between −300 V to −1200 V, however, the exact value of grid voltage depends on the geometry of the charger, components used in the charger, and the charging requirements.

Figure 2:
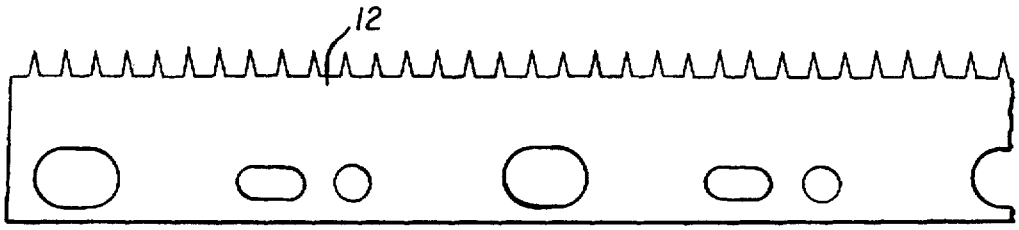
FIG. 2 is a perspective view of a sawtooth blade of the sawtooth AC corona charger shown in FIG. 1.

Variable duty power supply 50 generates a high voltage AC signal which is applied to the sawtooth blades 12, shown in more detail in FIG. 2. The image of a portion of a sawtooth blade in FIG. 2 was obtained by photocopying a blade removed from the primary charger of a Xerox Model 5100 copier. The magnification is 2×. Such blades are used in the Example below, in which three blades are mounted in the charger in staggered fashion; with the point 15 of each blade 120° out of alignment with the points of each adjacent blade. The duty cycle of the AC voltage signal applied to sawtooth blades 12 is greater than approximately 50% and preferably less than approximately 90%. A duty cycle of 90% has been found to yield excellent results. A typical range of the amplitude AC voltage signal is ±6,000 to 9,000 volts, at 600 Hz. However, this voltage and this frequency may be varied depending on other operating specifications and components. For example, the frequency may be in the range of approximately 60 Hz to 6,000 Hz and the voltage may be in the range of 5,000 volts to 12,000 volts.

In the practice of this invention, the potential on the sawtooth blades is greater than a threshold voltage for corona emission for each polarity. In the preferred embodiment, the AC voltage signal applied to the sawtooth blades has a trapezoidal waveform, although other waveforms may be useful in the practice of the invention.

Figure 3:
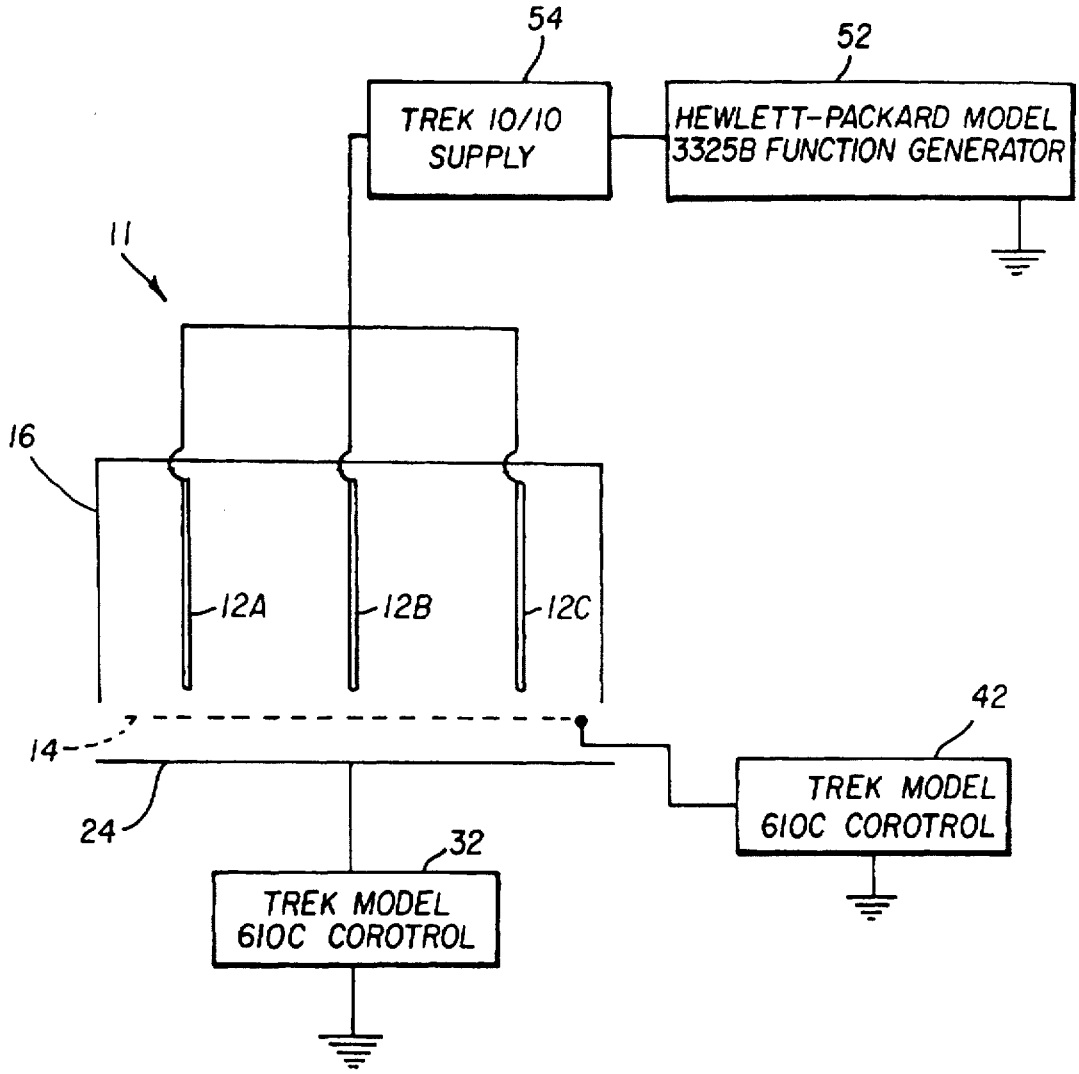
FIG. 3 is a schematic view of a test apparatus for a sawtooth AC corona charger according to the present invention.

FIG. 3 is a schematic illustration of a test apparatus 11 used to measure large area plate current versus sawtooth blade voltage at various duty cycles. The invention was tested using a commercially manufactured charger, removed from a Xerox model 5100 copier with three sawtooth blades. This charger has a voltage-controllable grid. In the test apparatus, a low voltage AC signal was generated by a Hewlett-Packard Model 3325 function generator 52, which was amplified by a Trek Model 10/10 high voltage amplifier power supply 54. The output of power supply 54 was used to energize the sawtooth blades 12 of the 3-blade sawtooth corona charger. The waveform, the amplitude, and the duty cycle were set by the function generator 52. A square wave AC voltage signal at a frequency of 600 Hz was used in the experiment. Owing to the finite slew rate of the Trek 10/10 power supply 54, a trapezoidal waveform, rather than an actual square wave, was produced at the sawtooth blades 12. At 50% duty cycle, approximately 89% of the voltage of each positive or negative excursion was at peak. Potential at the grid 14 was provided by a Trek Model 610B Control power supply 42. The spacing between the grid and the grounded plate electrode was set at the same value as the spacing normally used for charging a photoconductor, approximately 2.2 mm. Ambient conditions for the experiments were: relative humidity 40–60%, temperature 70°–75° F. The plate electrode 24 simulates an uncharged photoconductor, and was used for measuring large area plate currents. Currents were measured with a Trek Model 610C Control unit 32.

It is useful to characterize charging current uniformity by measuring the charging current as a function of distance parallel to the sawtooth blades, which corresponds to a cross-track direction in a copier machine. The standard deviation of the mean charging current divided by the mean current is a noise-to-signal ratio defined as the cross-track charging current non-uniformity, which may be expressed as a percentage. The noise-to-signal ratio or non-uniformity of the emitted current was measured parallel to the length of the sawtooth blades.

Figure 4:
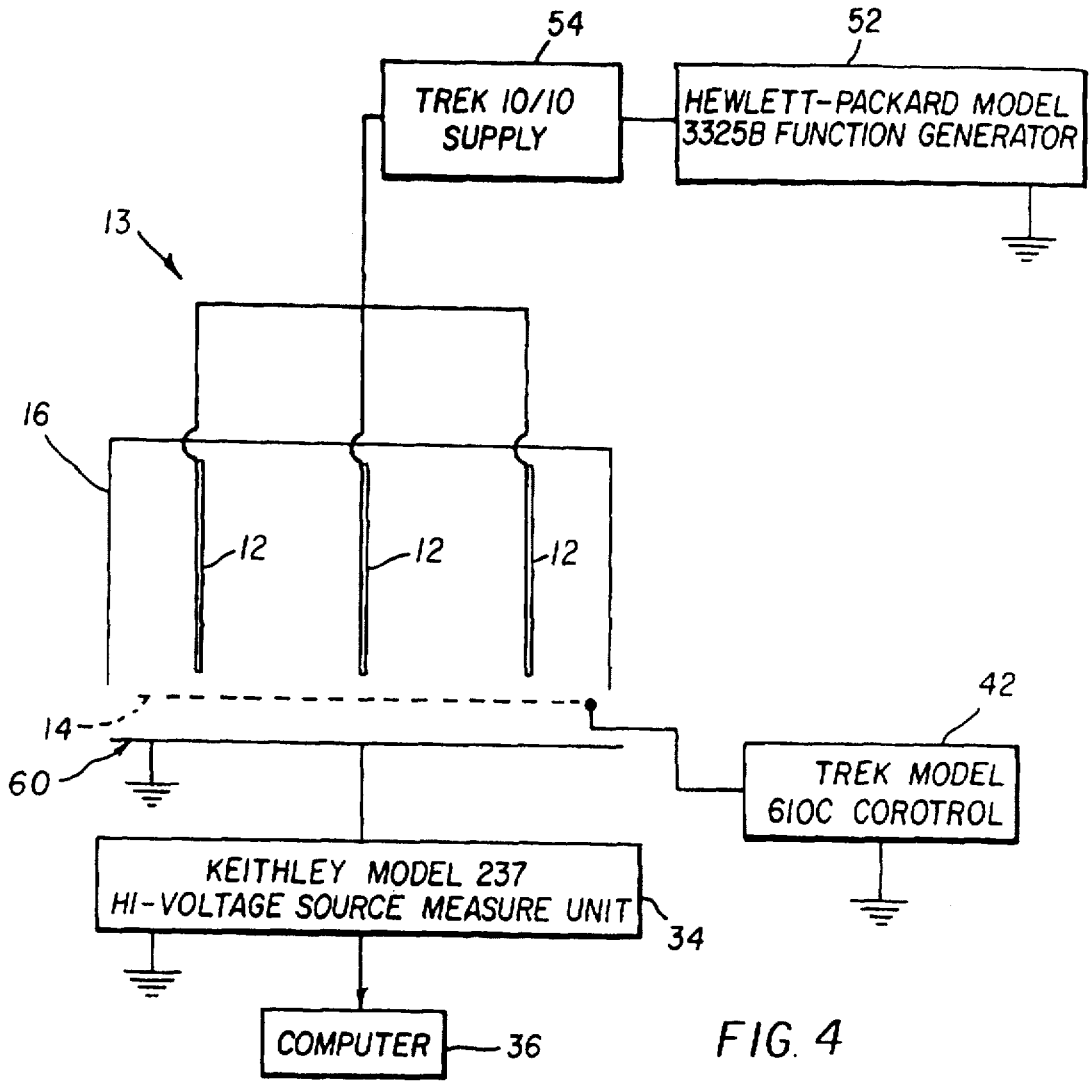
FIG. 4 is a schematic view of an alternate test apparatus for a sawtooth AC corona charger according to the present invention.
Figure 5:
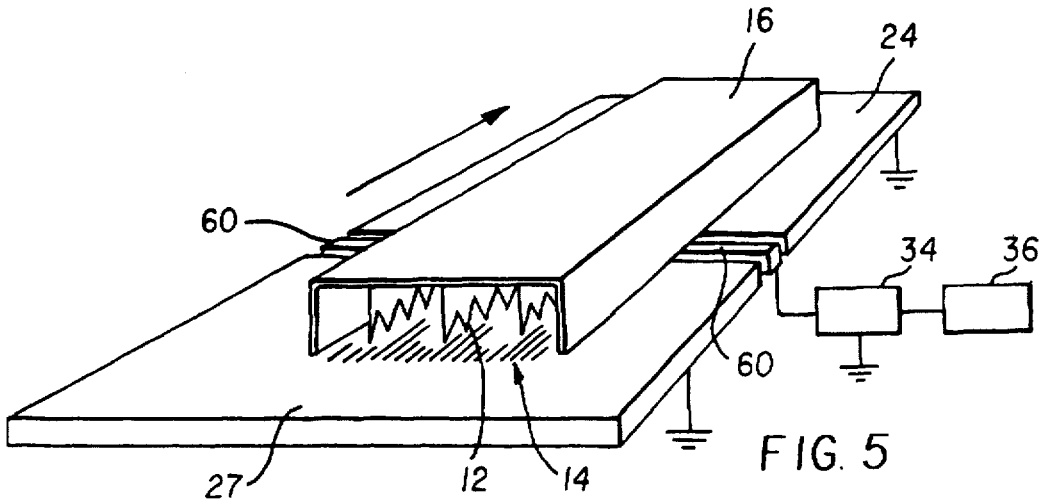
FIG. 5 is a perspective view of a test probe and plate of the apparatus shown in FIG. 4.

Noise-to-signal ratio was measured with a second apparatus 13, shown in FIGS. 4 and 5, using a scanning probe 60. The length of the scanning probe 60 was equal to the width of the sawtooth AC corona charger, and measured all three sawtooth blades simultaneously. Scanning probe 60 was a thin collector electrode, at ground potential, one millimeter wide, inserted in a narrow slit 26 cut in the grounded plate electrode 27, with the slit perpendicular to the sawtooth blades.

The output of the Keithley Model 237 Source Measurement Unit 34 was sent to a computer 36. Digitized records of current scans were obtained, with 3150 address points corresponding to the entire length of the sawtooth blades. Mean scanning probe currents and standard deviations of these currents were computed from the digitized records.

"Improvement of uniformity", as used in the experimental results, means a reduction in the standard deviation of the probe current along the entire length of the sawtooth blades. It can be shown that the crosstrack deviation of standard output voltage on a charged photoconductor as it exits the charging station of a typical copy machine is proportional to the standard deviation of the scanned current as measured by the scanning probe 60, divided by the mean current. Hence, the use of a scanning probe to measure the fluctuations of current transmitted by the grid is a useful predictor of the output uniformity performance of the AC charger.

EXAMPLE

Improvement of Charging Uniformity at High Duty Cycle and Constant Charging Current The invention was demonstrated using a commercially manufactured 3-array sawtooth type primary charger, removed from a Xerox model 5100 copier, which had a voltage controllable grid. This Example demonstrates that high duty cycle operation provides unexpectedly improved uniformity of negative charging current compared with negative DC operation at the same charging current. This is shown for four different charging currents: −120, −275, −525, and −640 μa (total time-integrated currents from the charger arriving at a grounded plate). These currents span a range of charging currents typically useful in commercial copiers using corona wire chargers. For reference, a conventional gridded 3-wire AC charger such as the 2100 series of Kodak Ektaprint copier typically operates with set points such that the charging current to a grounded plate is approximately −275 μa at a process speed of approximately 17.5 inches per second. Higher charging currents would be required, for example, for higher process speeds or for photoconductor capacitance higher than that employed in a 2100 series of Kodak Ektaprint copier.

TABLE 1

N/S VALUES WITH CONSTANT PLATE CURRENT AS DUTY CYCLE IS VARIED
(Peak Potential For Each Plate Current in Right Hand Column)
Spacing = 0.085 in, Vgrid = −1000 Volts, Vplate = 0

| Negative Duty | Plate Current (μa) | | | | V-peak |
|---|---|---|---|---|---|
| Cycle (%) | −120 | −275 | −525 | −640 | (KV) |
| 50 | **0.0943** | | | | 6.5 |
| 50 | 0.0909 | | | | 6.5 |
| 50 | 0.0923 | | | | 6.5 |
| 60 | **0.0986** | | | | 6.2 |
| 70 | **0.1172** | | | | 6.0 |
| 80 | **0.1298** | | | | 5.85 |
| 90 | **0.1524** | | | | 5.7 |
| 100 | **0.2460** | | | | 5.72 |
| 50 | | **0.0485** | | | 8.0 |
| 50 | | 0.0492 | | | 8.0 |
| 60 | | **0.0562** | | | 7.55 |
| 70 | | **0.0625** | | | 7.2 |
| 80 | | **0.0744** | | | 6.95 |
| 90 | | **0.0818** | | | 6.62 |
| 90 | | 0.0856 | | | 6.5 |
| 100 | | **0.1326** | | | 6.42 |
| 70 | | | **0.0380** | | 8.8 |
| 80 | | | **0.0433** | | 8.4 |

TABLE 1-continued

N/S VALUES WITH CONSTANT PLATE CURRENT AS DUTY CYCLE IS VARIED
(Peak Potential For Each Plate Current in Right Hand Column)
Spacing = 0.085 in, Vgrid = −1000 Volts, Vplate = 0

| Negative Duty | Plate Current (μa) | | | | V-peak |
|---|---|---|---|---|---|
| Cycle (%) | −120 | −275 | −525 | −640 | (KV) |
| 90 | | | **0.0463** | | 8.0 |
| 90 | | | 0.0468 | | 8.0 |
| 100 | | | **0.0642** | | 7.5 |
| 90 | | | | **0.0397** | 8.55 |
| 100 | | | | **0.0502** | 8.0 |
| 100 | | | | 0.0494 | 8.0 |
| 100 | | | | 0.0452 | 8.0 |

Note to Table 1: N/S entries that are not in bold type are repeat experiments (see text).

Figure 6:
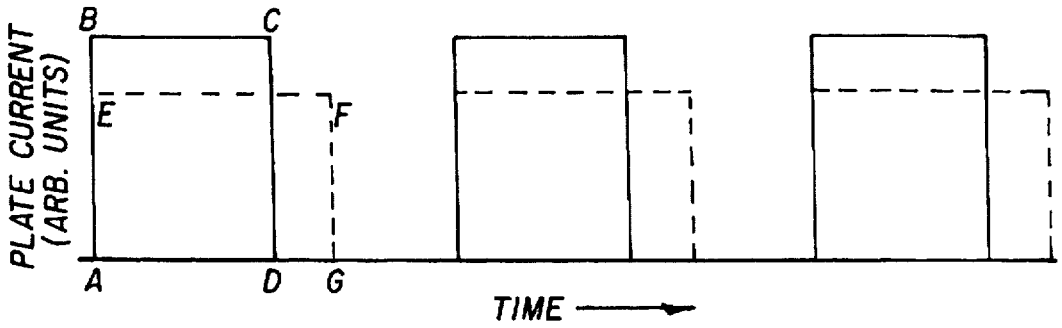
FIG. 6 shows plate current versus time for constant current charging.

As duty cycle is reduced at constant plate current, the peak potential applied to the sawtooth blades must be increased in order to produce the appropriate emission and charging currents to a grounded plate. This is shown schematically in FIG. 6, which compares the situation for an idealized rectangular current waveform for duty cycles of 50% and 67%. Areas ABCD and AEFG are the same, and peak charging currents are in the ratio 4 to 3. Table 1 gives values of N/S ratio four different charging currents and for duty cycles ranging from 50% to 100%, i.e., covering the range between conventional negative AC and negative DC operation. In the extreme right hand column of Table 1 are listed the peak voltages applied to the sawtooth blades that was necessary to keep the charging current constant. Higher charging currents require higher peak voltages, especially at lower duty cycles. To avoid impractical large peak voltages, data were not collected when plate current was high and duty cycle low.

Figure 7:
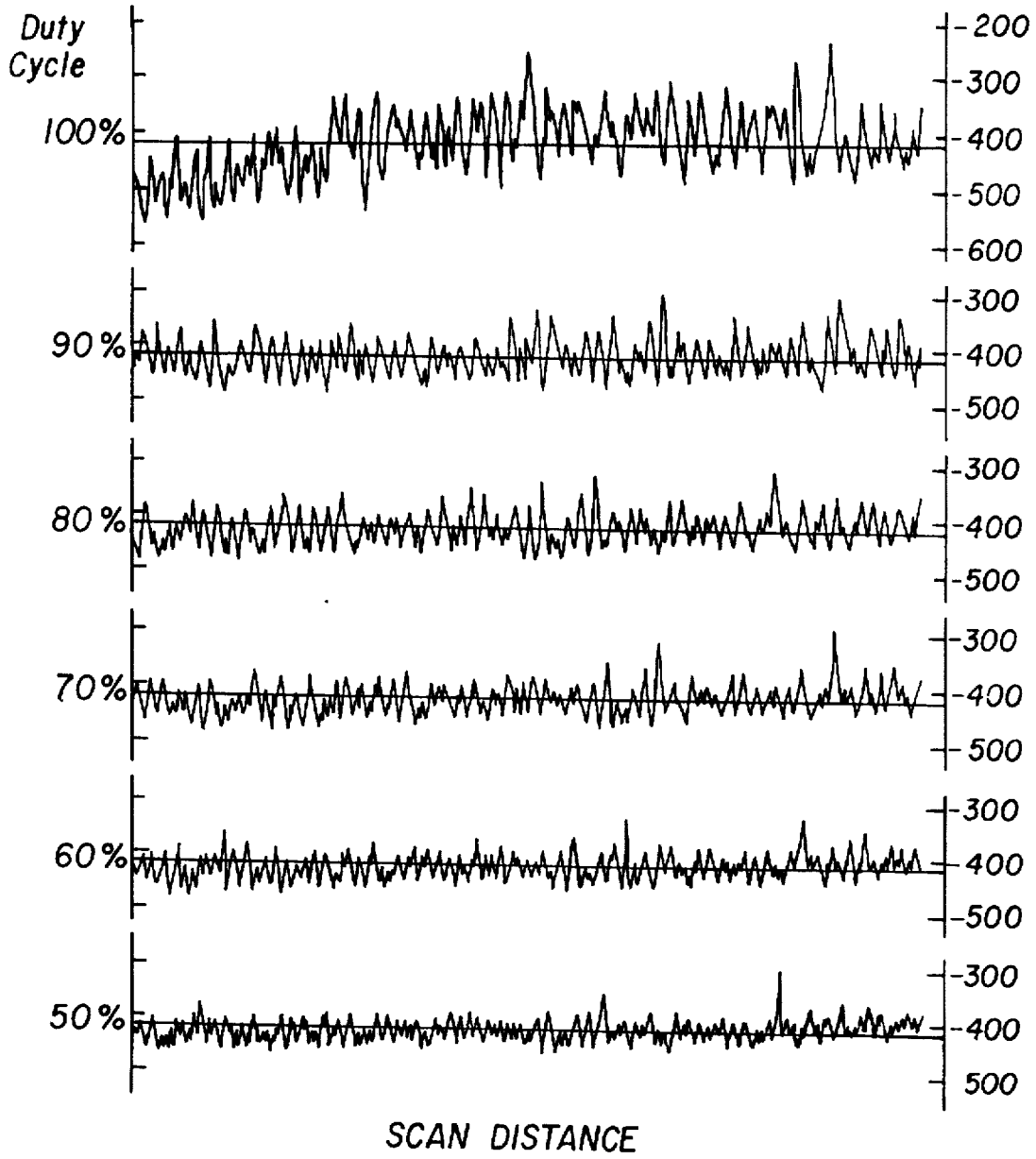
FIG. 7 shows graphs of total plate current versus scan distance.

FIG. 7 shows experimental traces obtained from the scanning probe with total charging current −275 μa (see Table 1). This corresponds to an average scanning probe current of −417 na. (A linear relation between probe current and total charging current was demonstrated.) The probe current numbers shown on the vertical scale at the right of FIG. 7 are in nanoamperes, with average values of probe current indicated by the horizontal solid lines, all averages being close to −415 na. It is clear that reducing the negative duty cycle from 100% to 90%, gives a marked and surprising reduction in the amplitude of the fluctuations of the charging current along the length of the entire charger. As the duty cycle is further decreased, the amplitude of the fluctuations continues to decrease, i.e., the N/S ratio continues to fall in magnitude (N decreases, S is constant).

Figure 8:
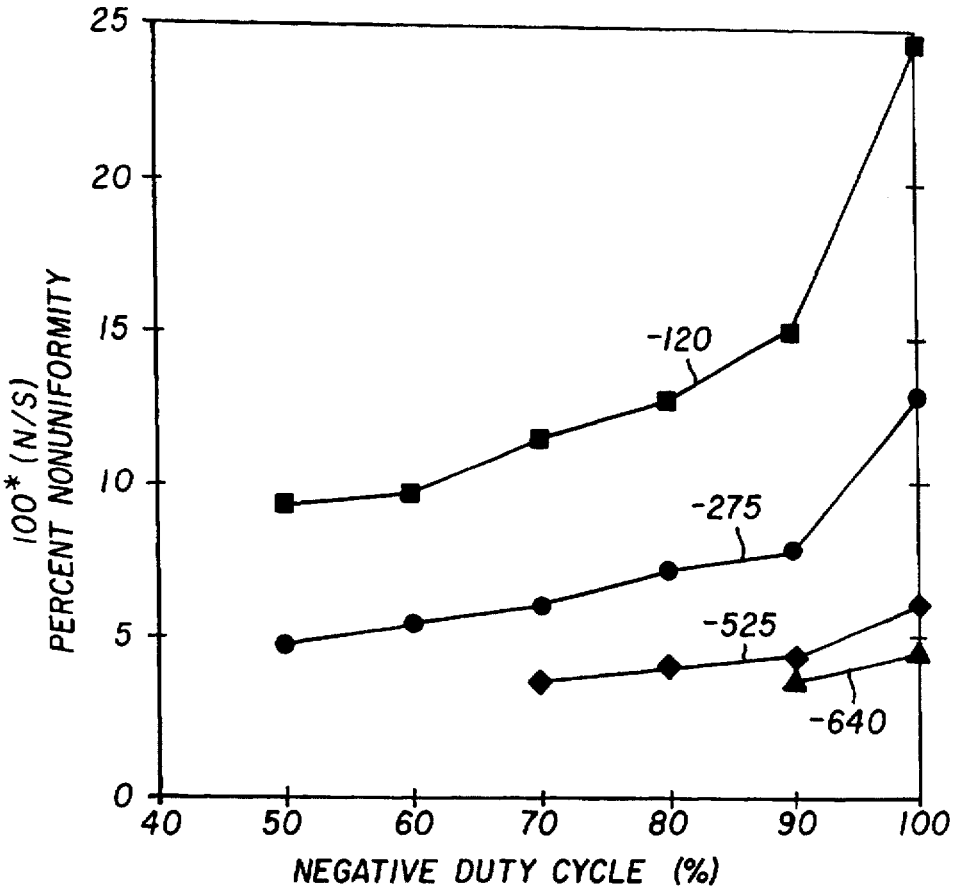
FIG. 8 shows a graph of percent nonuniformity versus percent negative duty cycle for various plate current.
Figure 9:
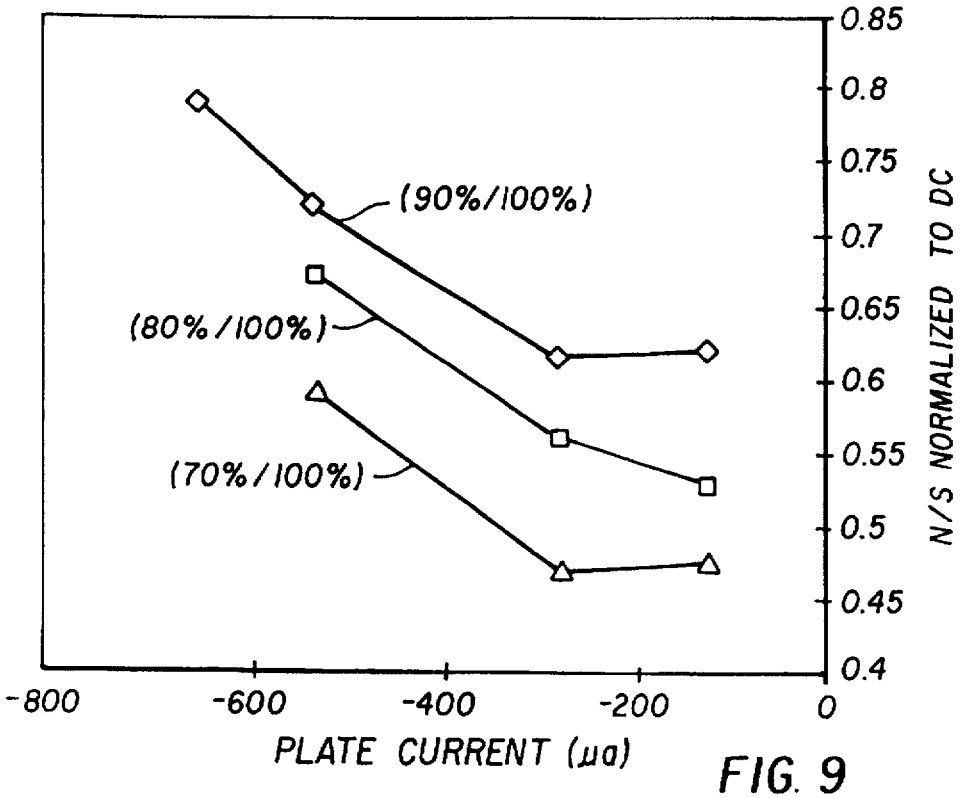
FIG. 9 shows a graph of normalized noise-to-signal ratio versus plate current.
Figure 10:
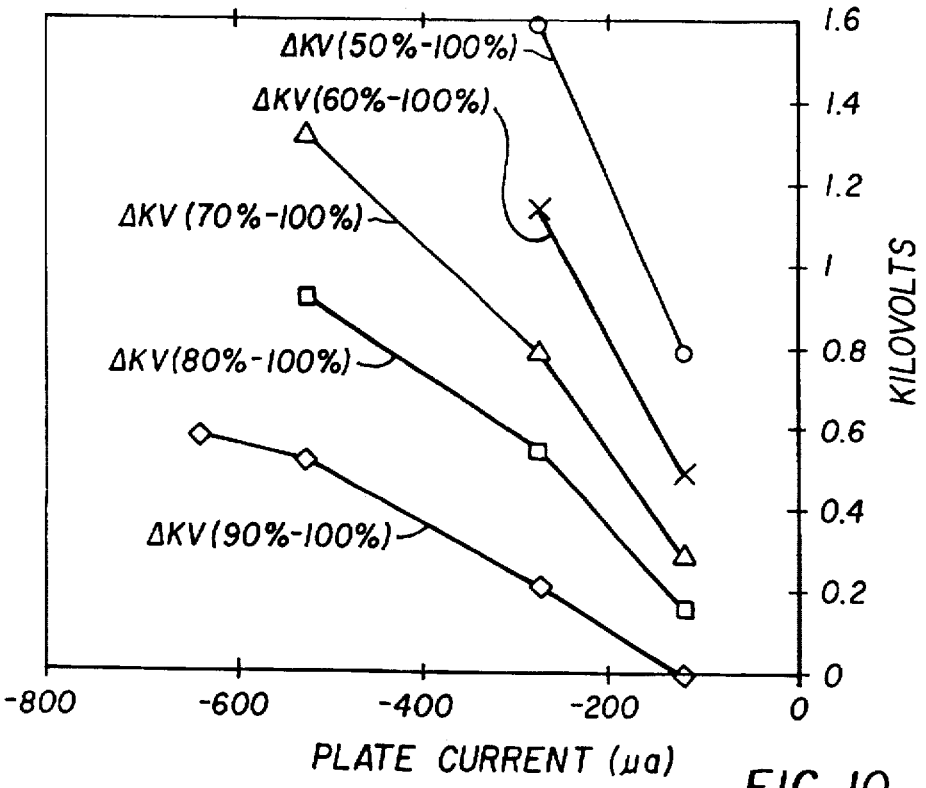
FIG. 10 shows a graph of increase in sawtooth blade peak potential versus plate current.

The bold type data in Table 1 have been used to create the graphs of FIGS. 8, 9, and 10. Inclusion of the repeat run data (non-bolded entries in Table 1) would not materially affect the conclusions drawn from these FIGS. In FIG. 8, the curve for a plate current of −275 μa corresponds to the data shown in FIG. 7. It can be seen that altering the charging modality from negative DC at 100% duty cycle to AC with a trapezoidal waveform at 90% negative duty cycle gives a large improvement in the percent nonuniformity (N/S multiplied by 100). This occurs for all the plate currents studied. As duty cycle is further reduced for each of the plate currents, there is a progressively improved (reduced) nonuniformity. These improvements are illustrated graphically in FIG. 9, which plots normalized values of nonuniformity, i.e., each point corresponds to the nonuniformity for a given duty cycle and plate current, divided by the nonuniformity for DC operation at the same plate current. The top curve of FIG. 9 is for 90% duty cycle, the middle curve for 80% duty cycle, and the bottom curve for 70% duty cycle. An example charging current to a grounded plate that corresponds to useful operation in many applications is −275 μa. FIG. 9 shows that the nonuniformity will be about 61% of the DC value for 90% duty cycle, about 53% at 80% duty cycle, and about 47% at 70% duty cycle. For a higher current of −400 μa, interpolation in FIG. 9 also illustrates that the nonuniformity will be about 67% of the DC value for 90% duty cycle, about 62% at 80% duty cycle, and about 53% at 70% duty cycle. These are significant and surprisingly large reductions, which have a very beneficial effect on the charging uniformity of a photoconductor, especially for the lower charging currents.

From Table 1 it is clear that in order to realize the advantage of reduced charging current nonuniformity, the peak KV must be increased as duty cycle is reduced. These increases are shown graphically in FIG. 10. Using an example charging current to a grounded plate of −275 μa, it is seen that the peak voltage must be increased by only about 0.20 KV for 90% duty cycle, about 0.52 KV at 80% duty cycle, and about 0.78 KV at 70% duty cycle. For −400 μa, the increases are somewhat greater, i.e., about 0.26 KV for 90% duty cycle, about 0.72 KV at 80% duty cycle, and about 1.04 KV at 70% duty cycle. All of these increases are practical from the point of view of increased demands on the AC power supply, as well as increased risk of arcing inside the charger itself, or in the high voltage connectors, or in the cabling. For the preferred mode of operation at 90% duty cycle, and for the lower charging currents, increases of peak potential are quite small, only a few hundred volts. This Example shows that a high duty cycle sawtooth AC corona charger, with a grid, and operated using a trapezoidal waveform, with a preferred negative duty cycle of about 90%, provides significantly enhanced negative charging uniformity compared to conventional DC operation. This can be accomplished using small increases of the peak voltage amplitude applied to the emitter arrays, as compared to DC operation.

The invention has been described in detail with particular reference to a preferred embodiment thereof, but it will be understood that variations and modifications can be effected within the spirit and scope of the invention as set forth in the claims. It is to be understood that the invention does not depend on any specific disposition or shape of electrodes, or combination of elements, or voltage or frequency ranges. The different configurations of these elements described, and choices of AC frequency and biases applied to sawtooth blades, are intended to illustrate how the invention may be used. In an operating charger the geometrical relationships between the sawtooth blades, grid, shell, and spacing between charger and photoconductor depend upon the practical range of potentials that are applied to the sawtooth blades in any particular charger structure. The materials described and the properties are also for purposes of illustration. For example, the shell could be conductive rather than insulating, the sawtooth blade shapes could be different, and the alignment between points on adjacent sawtooth blades could be different.

Although the invention has been described with respect to sawtooth blade, the invention is not limited to rows of conductors with triangular shaped points. Embodiments with pins on pin holders are equivalent to the sawtooth blades described above for the purposes of this invention.

| PARTS LIST |
|---|
| 10. Sawtooth AC corona charger |
| 11. Test Apparatus |
| 12. Sawtooth Blades |
| 13. Second Test Apparatus |
| 14. Grid |
| 15. Points |
| 16. Plastic shell |
| 20. Photoconductor |
| 21. Electrode |
| 22. Photosensitive layer |
| 23. Grounded conductive layer |
| 24. Plate electrode |
| 25. Base |
| 26. Narrow Slit |
| 27. Grounded Plate Electrode |
| 32. Power supply |
| 34. Measure unit |
| 36. Computer |
| 40. Power supply |
| 42. Power supply |
| 50. Variable duty power supply |
| 52. Generator |
| 54. Power supply |
| 60. Scanning probe |

We claim:

1. A sawtooth AC corona charger for charging a photoconductor, said charger comprising:

at least one sawtooth blade;

an AC voltage source connected to said sawtooth blade, said AC voltage source having a duty cycle greater than 50% wherein said duty cycle is less than approximately 90%.

2. A sawtooth AC corona charger for charging a photoconductor, said charger comprising:

at least one sawtooth blade;

an AC voltage source connected to said sawtooth blade, said AC voltage source having a duty cycle greater than 50% wherein said duty cycle is approximately 70%.

3. A sawtooth AC corona charger for charging a photoconductor, said charger comprising:

at least one sawtooth blade;

an AC voltage source connected to said sawtooth blade, said AC voltage source having a duty cycle greater than 50% wherein said duty cycle applied to said sawtooth blade is negative.

4. A sawtooth AC corona charger for charging a photoconductor, said charger comprising:

at least one sawtooth blade;

an AC voltage source connected to said sawtooth blade, said AC voltage source having a duty cycle greater than 50% wherein the AC voltage source produces a trapezoidal waveform signal.

5. A sawtooth AC corona charger for charging a photoconductor, said charger comprising:

at least one sawtooth blade;

an AC voltage source connected to said sawtooth blade, said AC voltage source having a duty cycle greater than 50% wherein said AC voltage source operates at a frequency of between approximately 60 Hz and 6,000 Hz.

6. A sawtooth AC corona charger, for charging a photoconductor comprising:

at least one sawtooth blade;

a shell partially surrounding said sawtooth blade;

a voltage controlled grid between said sawtooth blade and said photoconductor;

means for applying a trapezoidal AC voltage waveform to said sawtooth blade, wherein said waveform has a time duration in a first polarity portion of said waveform greater than a time duration in a second polarity portion of said waveform such that a potential on the sawtooth blade is greater than a threshold voltage for corona emission for both said first polarity and said second polarity of the corona sawtooth blade.

7. A sawtooth AC corona charger as in claim 6 wherein said voltage waveform is trapezoidal.

8. A sawtooth AC corona charger as in claim 6 wherein said voltage waveform has first shape when said voltage waveform is said first polarity, and said voltage waveform has a second wave shape when said voltage waveform is said second polarity.

9. A sawtooth AC corona charger as in claim 6 wherein a time integrated AC component of said voltage waveform has an absolute value greater than zero for at least one complete cycle of said AC voltage waveform.

10. A corona charger as in claim 6 wherein said first polarity portion of said waveform is negative.

11. In a sawtooth AC corona charger for an electrophotographic copying system a method of charging a photoconductor comprising the steps of:

applying an AC voltage signal having a duty cycle greater than 50% to a sawtooth blade partially enclosed by a shell, wherein a potential on said sawtooth blade is greater than a threshold voltage for corona emission for both a positive polarity and a negative polarity of said AC voltage signal; and applying a voltage to a grid, located between said sawtooth blade and said photoconductive;

wherein said AC voltage signal is an asymmetric waveform.

12. In a sawtooth AC corona charger for an electrophotographic copying system a method of charging a photoconductor comprising the steps of:

applying an AC voltage signal having a duty cycle greater than 50% to a sawtooth blade partially enclosed by a shell, wherein a potential on said sawtooth blade is greater than a threshold voltage for corona emission for both a positive polarity and a negative polarity of said AC voltage signal; and applying a voltage to a grid, located between said sawtooth blade and said photoconductive;

wherein said duty cycle is negative.

13. In a sawtooth AC corona charger for an electrophotographic copying system a method of charging a photoconductor comprising the steps of:

applying an AC voltage signal having a duty cycle greater than 50% to a sawtooth blade partially enclosed by a shell, wherein a potential on said sawtooth blade is greater than a threshold voltage for corona emission for both a positive polarity and a negative polarity of said AC voltage signal; and applying a voltage to a grid, located between said sawtooth blade and said photoconductive;

wherein said time integrated AC component of said AC voltage signal has an absolute value greater than zero for at least one complete cycle of the AC voltage signal.

* * * * *